US008927845B2

(12) United States Patent
Kato et al.

(10) Patent No.: US 8,927,845 B2
(45) Date of Patent: Jan. 6, 2015

(54) ELECTRONIC KEYBOARD MUSICAL INSTRUMENT

(71) Applicant: Yamaha Corporation, Hamamatsu-shi, Shizuoka-ken (JP)

(72) Inventors: Takashi Kato, Hamamatsu (JP); Takao Koyama, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 14/245,680

(22) Filed: Apr. 4, 2014

(65) Prior Publication Data

US 2014/0298976 A1 Oct. 9, 2014

(30) Foreign Application Priority Data

Apr. 5, 2013 (JP) ..... 2013-079327
Feb. 25, 2014 (JP) ..... 2014-033999

(51) Int. Cl.
*G10C 3/12* (2006.01)
*G10H 1/32* (2006.01)

(52) U.S. Cl.
CPC ..... *G10H 1/32* (2013.01)
USPC ..... 84/423 R

(58) Field of Classification Search
USPC ..... 84/423 R, 453, 438, 440, 450
See application file for complete search history.

(56) References Cited

FOREIGN PATENT DOCUMENTS

JP 63-217897 A 9/1988
JP 3797164 B2 4/2006

*Primary Examiner* — Kimberly Lockett
(74) *Attorney, Agent, or Firm* — Rossi, Kimms & McDowell LLP

(57) ABSTRACT

An electronic keyboard musical instrument, including: a housing having a lower casing having a bottom wall and an upper casing having a top wall, left and right walls being formed on at least one of the top wall and the bottom wall; a keyboard portion held by the housing; at least one speaker disposed at at least one end portion of the housing in its key arrangement direction, such that its sound emission surface faces rearward; a sound adjuster disposed in the housing so as to be located outward of the speaker in the left-right direction; and a plurality of protruding portions formed at the one end portion so as to protrude from the at least one of the top and bottom walls, wherein the sound adjuster is held by at least one of the protruding portions.

11 Claims, 7 Drawing Sheets

ELECTRONIC KEYBOARD MUSICAL INSTRUMENT

CROSS REFERENCE TO RELATED APPLICATION

The present application claims priority from Japanese Patent Application Nos. 2013-079327 and 2014-033999, which were filed on Apr. 5, 2013, and Feb. 25, 2014, respectively, the disclosure of which is herein incorporated by reference in its entirety.

BACKGROUND OF THE INVENTION

1. Field of the Invention

The present invention relates to an electronic keyboard musical instrument having speakers for generating musical sounds disposed at left and right end portions of its housing.

2. Description of Related Art

There have been conventionally known an electronic keyboard musical instrument having speakers for generating musical sounds that are disposed at left and right end portions of its housing. In the musical instrument described in the following Patent Literature 1, for instance, a pair of left and right speakers are provided on the rear of the housing. When acoustic characteristics are considered, it is recognized that there are convexities and concavities in an inside of the housing of the keyboard musical instrument due to a layout of circuit boards and various components, and such convexities and concavities are physical factors that influence acoustic characteristics (decibel value of sound pressure with respect to frequency) of the speakers.

A speaker device according to the following Patent Literature 2 incorporates, in its speaker box, a sound absorbing body formed of a cushioning material in an attempt to improve acoustic characteristics in the speaker box. To approximate the acoustic characteristics to desired ones, the sound absorbing body is formed to have a curved surface shape, and reinforcing members are attached to and interposed in the sound absorbing body to keep the shape of the sound absorbing body. Thus, stable characteristics are maintained.

Patent Literature 1: Japanese Patent 3797164

Patent Literature 2: JP-A-63-217897

SUMMARY OF THE INVENTION

However, in an inside of a housing of an electronic keyboard musical instrument, many components such as boards and electronic components are disposed. Accordingly, there are many limitations in mounting the sound absorbing body to the housing of the electronic keyboard musical instrument, suffering from a low degree of freedom in mounting the sound absorbing body. From the viewpoint of acoustic characteristics, in particular, an appropriate layout of the sound absorbing body in the electronic keyboard musical instruments is not necessarily the same as that in the speaker device described in the above Patent Literature 2.

In the meantime, the sound absorbing body needs to be fixedly held in the housing in some suitable way. However, provision of a dedicated holding mechanism or provision of the members for holding the shape of the sound absorbing body as described in the above Patent Literature 2 inevitably increases the number of required components and makes the structure complicated.

In the meantime, speakers are often disposed at left and right end portions of electronic keyboard musical instruments. In this instance, it is preferable to take account of suppressing sound leakage from a left side and a right side of a housing. In particular, it is required to take measures for reducing a ratio of interference between sound leakage (opposite phase sound) from left and right side walls of a housing in the bass range and normal phase sound from the front of each speaker. As such measures, it is considered to make the left and right side walls heavier and thicker, for instance. However, such measures make it difficult to realize a portable musical instrument demanded by a user.

The present invention has been developed to solve the conventionally experienced problems. It is therefore an object of the invention to provide an electronic keyboard musical instrument that ensures enhanced acoustic characteristics and that suppresses structural complexity by permitting a protruding portion to have a function of reinforcing a housing and a function of holding a sound absorber.

The object indicated above may be attained according to a principle of the present invention, which provides an electronic keyboard musical instrument, comprising: a housing having a lower casing which has a bottom wall and in which an instrument component is disposed and an upper casing which has a top wall and which is attached to the lower casing, a left wall and a right wall being formed on at least one of the top wall of the upper casing and the bottom wall of the lower casing; a keyboard portion held by the housing; at least one speaker disposed at at least one end portion of the housing in a key arrangement direction of the housing on a rear side of the keyboard portion, such that a sound emission surface of the at least one speaker faces rearward, the at least one speaker being configured to generate a musical sound; a sound adjuster disposed in the housing so as to be located outward of the at least one speaker in the key arrangement direction; and a plurality of protruding portions formed at the at least one end portion of the housing so as to protrude from the at least one of the top wall of the upper casing and the bottom wall of the lower casing, wherein the sound adjuster is held by at least one of the plurality of protruding portions.

FORMS OF THE INVENTION

There will be described various forms of the invention.

An electronic keyboard musical instrument, comprising: a housing having a lower casing (120) which has a bottom wall (120*e*, 120*f*) and in which an instrument component is disposed and an upper casing (110) which has a top wall (110*e*) and which is attached to the lower casing, a left wall (110*a*; 123) and a right wall (110*b*) being formed on at least one of the top wall of the upper casing and the bottom wall of the lower casing; a keyboard portion held by the housing; at least one speaker disposed at at least one end portion of the housing in a key arrangement direction of the housing on a rear side of the keyboard portion, such that a sound emission surface of the at least one speaker faces rearward, the at least one speaker being configured to generate a musical sound; a sound adjuster (70) disposed in the housing so as to be located outward of the at least one speaker in the key arrangement direction; and a plurality of protruding portions (10, 20, 30, 40, 50, 53, 60, 63, 121; 210; 220) formed at the at least one end portion of the housing so as to protrude from the at least one of the top wall of the upper casing and the bottom wall of the lower casing, wherein the sound adjuster is held by at least one of the plurality of protruding portions.

According to the electronic keyboard musical instrument constructed as described above, it is possible to improve acoustic characteristics and to suppress structural complexity by permitting the protruding portion to have a function of reinforcing the housing and a function of holding the sound adjuster.

In the electronic keyboard musical instrument constructed as described above, at least one (10, 20, 30, 40; 121; 210; 220) of the plurality of protruding portions may have a fastening function for attaching the upper easing and the lower casing to each other.

According to the thus constructed electronic keyboard musical instrument, the protruding portion also has a function for assembling the housing.

In the electronic keyboard musical instrument constructed as described above, at least one (10, 20, 30, 40, 50, 60, 121) of the plurality of protruding portions may have at least one rib (12, 22, 32, 42, 52, 62, 122) formed integrally therewith, the left wall (110*a*; 123) and the right wall (110*b*) may be formed on the at least one of the top wall of the upper casing and the bottom wall of the lower casing on which the plurality of protruding portions are formed, and the at least one rib may be configured to be connected to one of the left wall and the right wall that is nearer to the at least one of the plurality of protruding portions having the at least one rib.

According to the thus constructed electronic keyboard musical instrument, it is possible to increase rigidity of the protruding portion and to enhance an effect of reinforcing one of the upper casing and the lower casing.

In the electronic keyboard musical instrument constructed as described above, at least one (10, 20, 30, 40, 53, 63; 220) of the plurality of protruding portions may have at least one rib (13, 14, 15, 23, 25, 26, 34, 43, 45, 46, 55, 65, 222-225, 18, 122), the left wall (110*a*; 123) and the right wall (110*b*) may be formed on the at least one of the top wall of the upper casing and the bottom wall of the lower casing on which the plurality of protruding portions are formed, and the at least one rib may be configured to be connected to the at least one of the top wall of the upper casing and the bottom wall of the lower casing and is configured not to be connected to the left wall and the right wall.

In the electronic keyboard musical instrument constructed as described above, at least one (10, 20, 30, 40; 220; 121) of the plurality of protruding portions may have at least one rib (12, 14, 22, 23, 32, 34, 42, 43, 46; 222-225; 18, 122), and the at least one rib may be configured to hold the sound adjuster (70).

According to the thus constructed electronic keyboard musical instrument, the sound adjuster can be held with high stability.

In the electronic keyboard musical instrument constructed as described above, the at least one of the plurality of protruding portions may have a plurality of ribs as the at least one rib, the plurality of ribs including two ribs (12, 13, 14, 15, 22, 23, 25, 32, 34, 42, 43, 45: 220-225) that extend in one and the other of two mutually intersecting directions in plan view.

According to the thus constructed electronic keyboard musical instrument, it is possible to farther increase rigidity of the protruding portion.

In the electronic keyboard musical instrument constructed as described above, the left wall (110*a*; 123) and the right wall (110*b*) may be formed on the at least one of the top wall of the upper casing and the bottom wall of the lower casing on which the plurality of protruding portions are formed, and the sound adjuster may be held so as to be spaced apart from the left wall and the right wall.

According to the thus constructed electronic keyboard musical instrument, it is possible to effectively suppress a fluctuation in acoustic characteristics.

In the electronic keyboard musical instrument constructed as described above, the sound adjuster may be held by the plurality of protruding portions.

According to the thus constructed electronic keyboard musical instrument, it is possible to hold the sound adjuster while enabling positioning thereof, without a need of screwing.

In the electronic keyboard musical instrument constructed as described above, the sound adjuster may be held by a plurality of ribs (12, 14, 22, 23, 26, 32, 34, 42, 43, 46, 18) of the plurality of protruding portions.

In the electronic keyboard musical instrument constructed as described above, the sound adjuster may be a sound absorber.

In the electronic keyboard musical instrument constructed as described above, the at least one of the plurality of protruding portions may have a function of reinforcing at least one of the upper casing and the lower casing.

The reference numerals in the brackets attached to respective constituent elements in the above description correspond to reference numerals used in the following embodiments to identify the respective constituent elements. The reference numerals attached to each constituent element indicates a correspondence between each element and its one example, and each element is not limited to the one example.

BRIEF DESCRIPTION OF DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter explained embodiments of the invention with reference to the drawings.

Figure 1A:
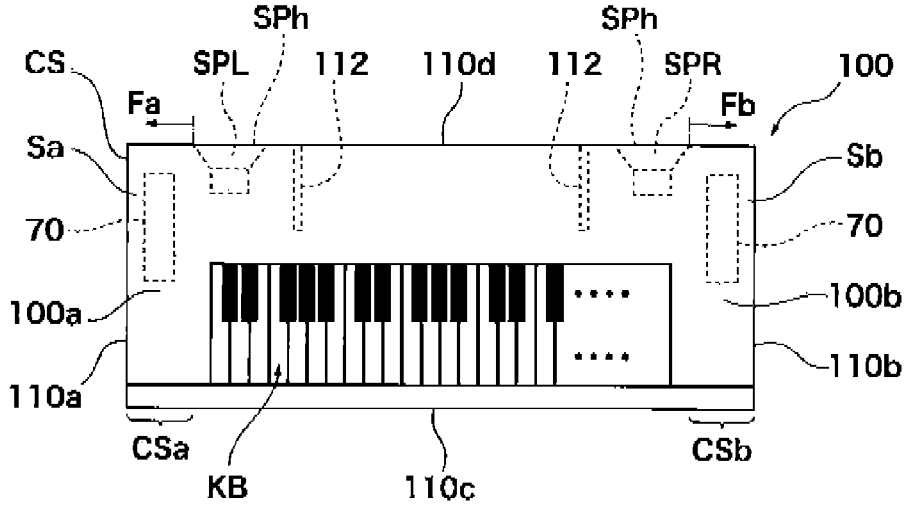
FIG. 1A is a plan view and FIG. 1B is a perspective view in vertical cross section each showing an electronic keyboard musical instrument according to one embodiment of the present invention.
Figure 1B:
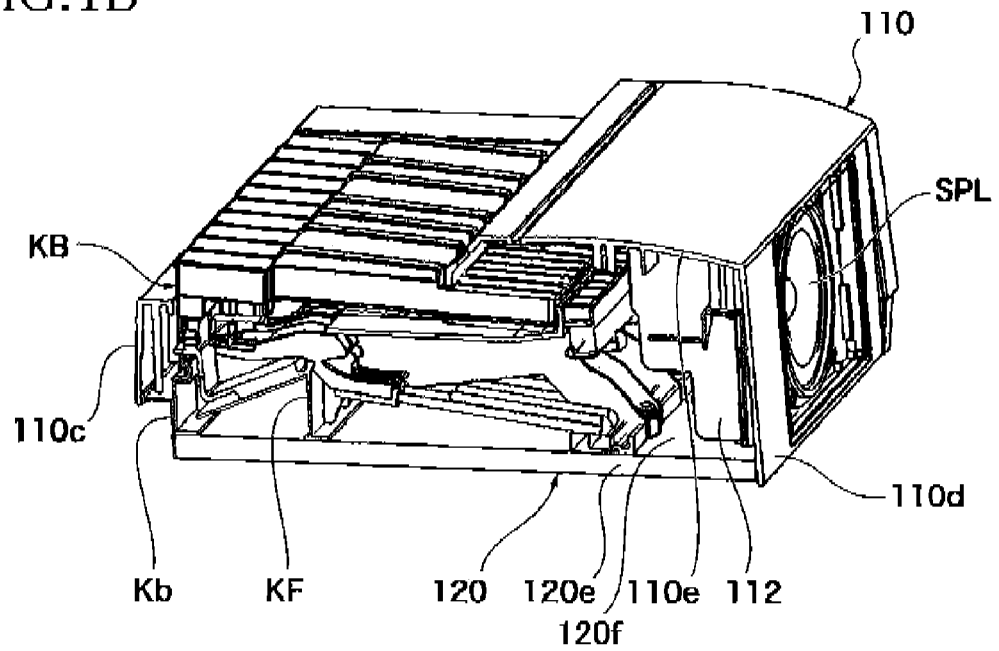

FIG. 1A is a plan view and FIG. 1B is a perspective view in vertical cross section each showing an electronic keyboard musical instrument according to one embodiment of the invention.

The electronic keyboard musical instrument generally indicated at 100 in FIG. 1A has a keyboard portion KB (as one example of an instrument component) having a plurality of keys. Hereinafter, terms such as "front-rear direction", "left-right direction", and "up-down (vertical) direction" are used based on a state in which the electronic keyboard musical instrument 100 is placed on a floor or the like. The longitudinal direction of the electronic keyboard musical instrument 100 (i.e., a key arrangement direction) is defined as the left-right direction. As for the front-rear direction, the side on which the keyboard portion KB is disposed (i.e., performer's side) is referred to as "front side".

As shown in FIG. 1A, speakers SP (SPL, SPR) are respectively disposed at a left end portion 100*a* and a right end portion 100*b* of the electronic keyboard musical instrument 100, i.e., at a left end portion and a right portion of a housing CS. Each speaker SP is disposed on a rear side of the keyboard portion KB such that a sound emission surface SPh of the speaker SP faces rearward. Each speaker SP is configured to generate a musical sound based on performance of the keyboard portion KB and automatic performance data.

As shown in FIG. 1B, the housing CS is provided by a lower chassis 120 (as one example of a lower casing) and an upper casing 110 that are attached to each other. The keyboard portion KB is disposed on a key frame KF provided on a key bed 120*e* of the chassis 120. The upper casing 110 is formed of resin and is constituted by a top wall 110*e*, a left wall portion 110*a*, a right wall portion 110*b*, a front wall portion 110*c*, and a rear wall portion 110*d* that are formed integrally with each other, as shown also in FIGS. 2-4. The wall portions 110*a*-110*d* provide four wall portions in the horizontal direction that enclose the keyboard portion KB. The upper casing 110 is attached to the chassis 120 such that the upper casing 110 covers the keyboard portion KB from above and surrounds the periphery by the four wall portions 110*a*, 110*b*, 110*c*, 110*d*. The keyboard portion KB is disposed in the housing CS and may be held by not the chassis 120 but the upper casing 110. In other words, the housing CS at least has a top wall, a bottom wall, a left wall, and a right wall. The housing CS further has a rear wall that is formed on at least one of the top wall and the bottom wall. The keyboard portion KB is held by the housing CS such that at least a part of the keyboard portion KB is exposed from the top wall.

A lower key slip Kb is provided at a front end of the key bed 120*e* of the chassis 120 so as to extend upward therefrom. The front wall portion 110*c* of the upper casing 110 functions as an upper key slip. The lower key slip Kb may be formed integrally with the chassis 120. The lower key slip Kb may be provided on the upper casing 110, together with the front wall portion 110*c*.

In the upper casing 110, two partition plates 112 are formed integrally with and are continuous (connected) to the top wall 110*e* and the rear wall portion 110*d*. One of the two partition plates 112 is located on the right side of the speaker SPL so as to be adjacent to the speaker SPL while the other of the two partition plates 112 is located on the left side of the speaker SPR so as to be adjacent to the speaker SPR, as shown in FIG. 1A.

In the housing CS, two sound absorbers 70 (each as one example of a sound adjuster) are respectively mounted at one and the other of the left end portion 100*a* and the right end portion 100*b*. That is, the sound absorbers 70 are respectively disposed at a left end portion CSa and a right end portion CSb of the housing CS. Each sound absorber 70 is disposed outward of a corresponding one of the left and right speakers SP in the left-right direction. The left sound absorber 70 is disposed leftward of the speaker SPL (on one side of the speaker SPL indicated by an arrow Fa in FIG. 1A) while the right sound absorber 70 is disposed rightward of the speaker SPR (on one side of the speaker SPR indicated by an arrow Fb in FIG. 1A).

Each sound absorber 70 is formed of a porous cushioning material such as a sponge and has a function of converting sound into thermal energy by absorption or friction, so as to attenuate the sound. Each partition plate 112 has a function as an acoustic splitter and a function for reinforcing the upper casing 110. Each sound absorber 70 has a function of suppressing sound leakage to longitudinally opposite sides (the left and right sides) of the musical instrument 100, unfavorable sound reflection in the housing CS, and so on. Each speaker SP is enclosed, in the left-right direction, by the sound absorber 70 and the partition plate 112 that are adjacent thereto, whereby a high degree of sound emission efficiency toward the rear side of the musical instrument 100 is ensured.

The sound absorbers 70 are respectively disposed at one and the other of the left end portion 100*a* and the right end portion 100*b*. Further, the left sound absorber 70 is disposed so as to be spaced apart from the left wall portion 110*a* of the upper casing 110 with a spacing Sa interposed therebetween while the right sound absorber 70 is disposed so as to be spaced apart from the right wall portion 110*b* of the upper casing 110 with a spacing Sb interposed therebetween. Owing to the thus disposed sound absorbers 70, frequency characteristics of acoustic signals generated from the speakers SP are significantly improved as explained below with reference to FIG. 5.

Figure 2:
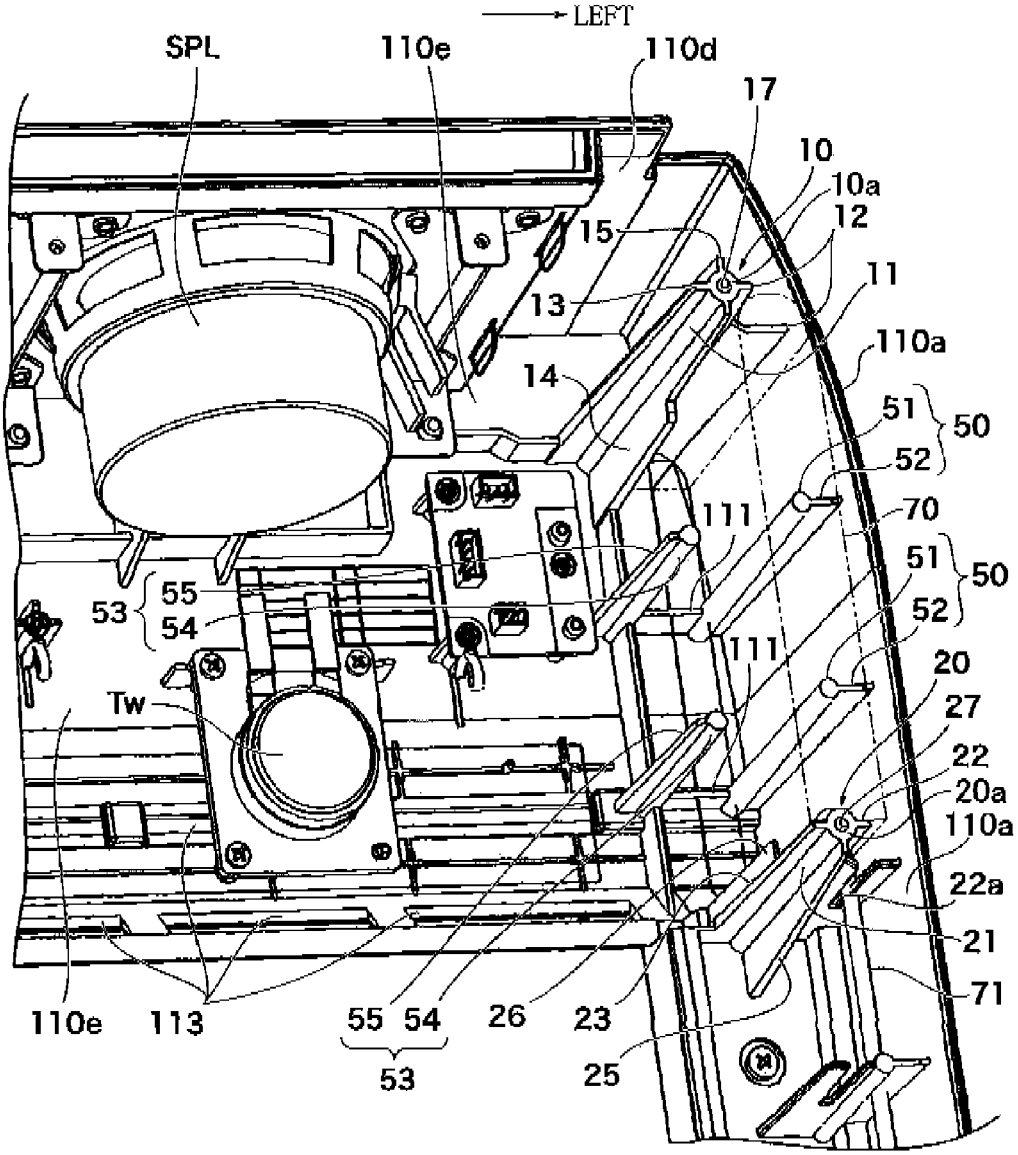
FIG. 2 is a perspective view of a left end portion of an upper casing when viewed from its backside.
Figure 3:
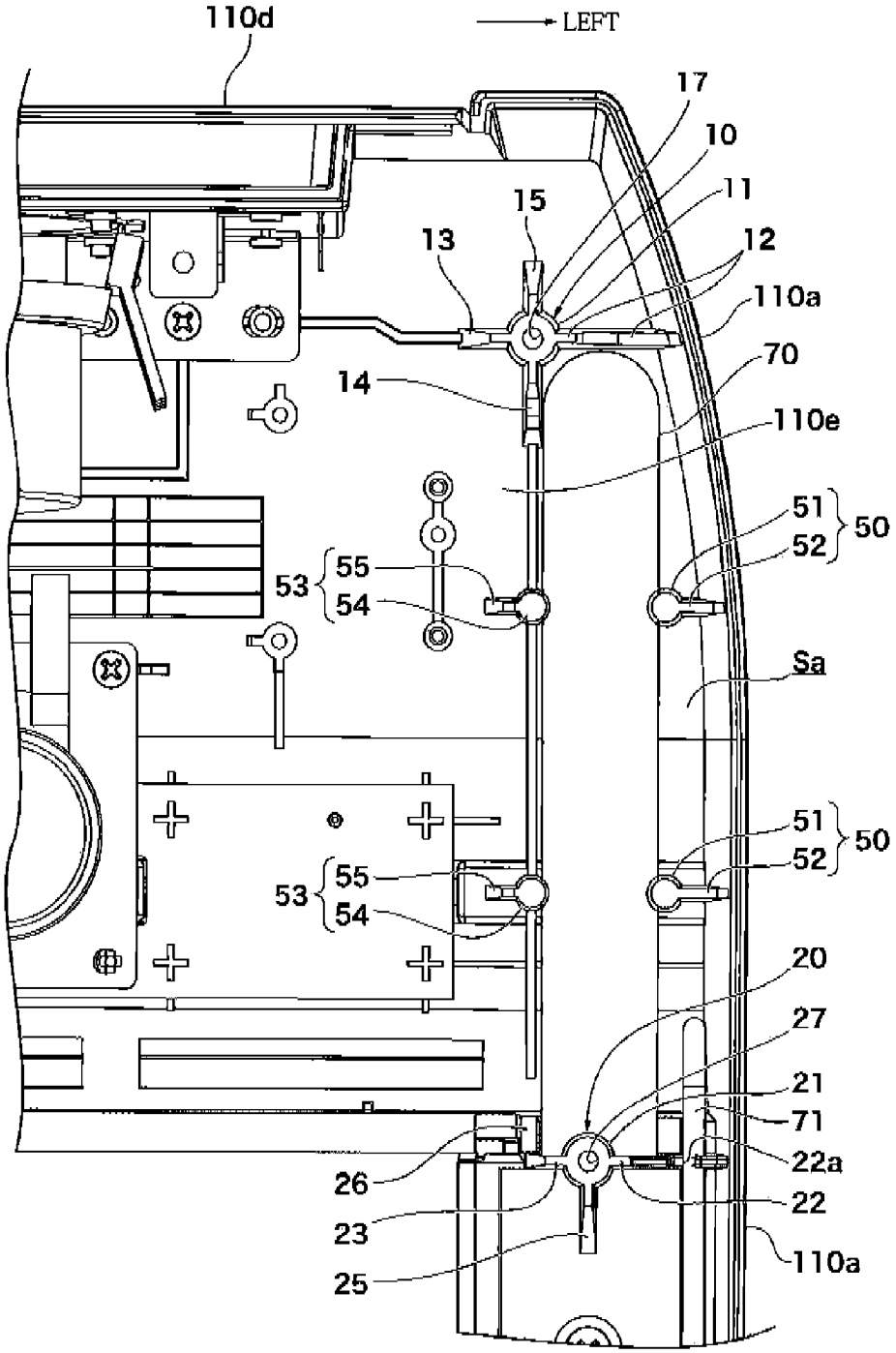
FIG. 3 is a backside view of the left end portion of the upper casing.

Referring next to FIGS. 2-4, there will be explained in detail a structure of holding the sound absorbers 70, FIG. 2 is a perspective view and FIG. 3 is a backside view, each showing the left end portion of the upper casing 110 when viewed from the backside.

As shown in FIG. 2, a tweeter Tw is provided in front of the speaker SPL on the top wall 110*e* such that a sound emission surface of the tweeter Tw faces upward. In the top wall 110*e*, sound emission holes 113 are formed as shown in FIG. 2. At the left end portion 100*a* (FIGS. 2 and 3) and the right end portion 100*b* (FIG. 4) of the electronic keyboard musical instrument 100, a plurality of suspending portions (each as one example of a protruding portion) are formed integrally with the top wall 110*e* of the upper casing 110 so as to be suspended therefrom. The left sound absorber 70 is held by the suspending portions. The suspending portions have a function for reinforcing the upper casing 110 though the function is not necessarily a main function thereof.

At the left end portion 100*a*, there are provided suspending portions 10, 20, 50, 53. Each of two suspending portions 10, 20 that are spaced apart from each other in the front-rear direction is a fastening portion (boss) for fastening the upper casing 110 and the chassis 120 to each other. The suspending portions 10, 20 respectively have shaft portions 11, 21 in which threaded holes 17, 27 are respectively formed. The key bed 120*e* (FIG. 1B) of the chassis 120 is formed with fastening holes corresponding to the threaded holes 17, 27. When the upper casing 110 and the chassis 120 are attached to each other, screws (not shown) are screwed into the threaded holes 17, 27. In a state in which the upper casing 110 is attached to the chassis 120 by screwing of the screws into the threaded holes 17, 27, distal end faces 10*a*, 20*a* (FIG. 2) of the respective suspending portions 10, 20 are in contact with a bottom surface 120*f* (FIG. 1B) of the chassis 120.

The shaft portions 11, 21 of the suspending portions 10, 20 are continuous (connected) to the left wall portion 110*a* by connecting ribs 12, 22, respectively. Ribs 13, 23 are formed so as to extend respectively from the shaft portions 11, 21 in the rightward direction that is opposite to the direction in which the connecting ribs 12, 22 extend. Ribs 14, 15 are formed so as to extend from the shaft portion 11 respectively in the frontward direction and the rearward direction. A rib 25 is formed so as to extend from the shaft portion 21 in the frontward direction, as shown in FIG. 3. These ribs 12-15, 22, 23, 25 are formed integrally with the corresponding shaft portions 11, 21 and are connected to the top wall 110*e*. A retainer rib 26 is formed so as to extend from the rib 23 in the rearward direction. The retainer rib 26 is also connected to the top wall 110*e*.

Two suspending portions 50 are formed so as to be suspended from the top wall 110*e*. The two suspending portions 50 are spaced apart from each other in the front-rear direction. Two suspending portions 53 are formed inward (rightward) of the respective suspending portions 50 in the left-right direction. Each suspending portion 50 has a shaft portion 51 that is connected to the left wall portion 110*a* by a connecting rib 52. Each suspending portion 53 has a shaft portion 54, and a rib 55 is formed so as to extend from the shaft portion 54 in the rightward direction. These ribs 52, 55 are formed integrally with the corresponding shaft portions 51, 54 and are connected to the top wall 110*e*. Further, a rib 111 is formed so as to protrude from the top wall 110*e* for connecting the shaft portion 51 and the shaft portion 54.

The ribs described above reinforce the shaft portions corresponding thereto and also reinforce the top wall 110*e*. In particular, each of the ribs connected to the left wall portion 110*a* has a function for reinforcing the left wall portion 110*a*. Owing to the thus formed ribs, the upper casing 110 has enhanced rigidity. In addition, some of the ribs are orthogonal to each other, ensuring a high reinforcement effect.

Each sound absorber 70 has a plate-like shape or substantially rectangular parallelepiped shape. The sound absorber 70 has a thickness in the left-right direction and is held by the suspending portions 10, 20, 50, 53. That is, the sound absorber 70 is sandwiched by the suspending portions 10, 20, 50, 53 owing to its elastic deformation, so as to be surrounded by the suspending portions 10, 20, 50, 53. More specifically, the sound absorber 70 is held mainly by the connecting rib 12 and the rib 14 of the suspending portion 10, the shaft portion 21, the connecting rib 22, the rib 23, and the retainer rib 26 of the suspending portion 20, the shaft portion 51 of the suspending portion 50, and the shaft portion 54 of the suspending portion 53, such that the sound absorber 70 is fitted into a space defined by these ribs and shaft portions. Accordingly, the sound absorber 70 can be mounted from the backside without any fixing means such as screwing. The shaft portions 51 are located distant from the left wall portion 110*a*, thereby providing a spacing Sa between the sound absorber 70 and the left wall portion 110*a*.

In a state in which the sound absorber 70 is mounted, the ribs 111 may function as a receiver (holder, retainer) that is in contact with the upper surface of the sound absorber 70. The key bed 120*e* of the chassis 120 is provided with ribs (not shown) similar to the ribs 111, so that the sound absorber 70 is immovably fixed on both of its upper side and lower side by those ribs, in other words, the sound absorber 70 is fixedly kept in place with respect to the vertical direction.

The connecting rib 22 is formed with an engagement portion 22*a* in the form of a recess, and wiring 71 is in engagement with and supported by the engagement portion 22*a*. The wiring 71 is disposed between the sound absorber 70 and the left wall portion 110*a*. While the wiring 71 is a wire connected to a USB terminal or a wire connected to a controller for effect control, for instance, the wiring 71 is not limited to this. In the arrangement, the wiring 70 does not interfere with the sound absorber 70 when routed, thereby obviating a risk of accidentally deforming the sound absorber 70. The wiring 71 is disposed in the spacing Sa between the sound absorber 70 and the left wall portion 110*a*, ensuring effective space utilization.

The engagement portion for supporting the wiring is not limited to the recess, but may be a hole. In addition to the engagement portion 22*a*, the engagement portion for supporting the wiring may be formed in each of the two connecting ribs 52, so as to permit the wiring 71 to be disposed over a substantially entire length of the sound absorber 70 in the front-rear direction. The engagement portion for supporting the wiring similar to the engagement portion 22*a* may be provided also at the right end portion of the upper casing 110.

Figure 4A:
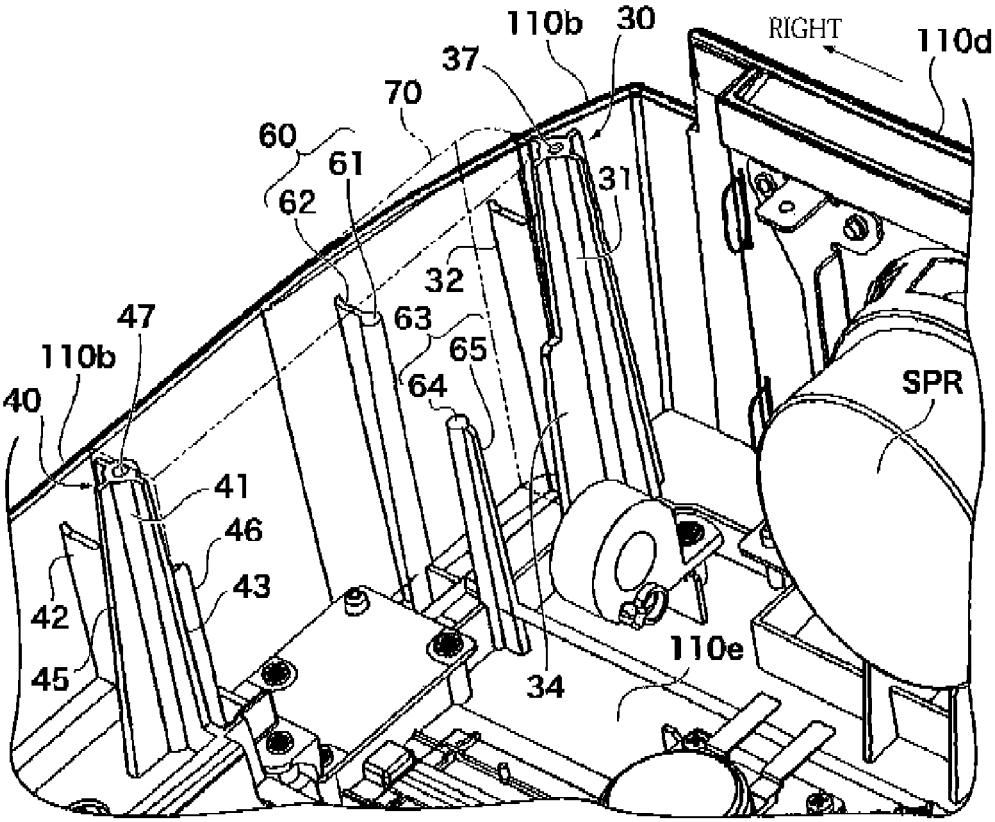
FIG. 4A is a perspective view and FIG. 4B is a backside view each showing a right end portion of the upper casing when viewed from its backside.
Figure 4B:
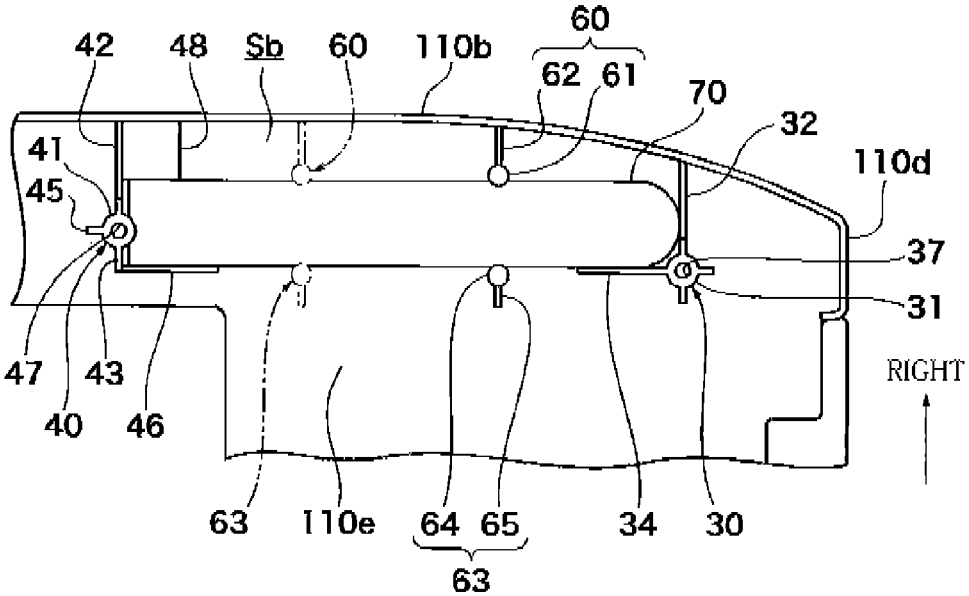

FIG. 4A is a perspective view and FIG. 4B is a backside view each showing the right end portion of the upper casing 110 when viewed from its backside. As in the left end portion 100*a*, the sound absorber 70 is held by a plurality of suspending portions in the right end portion 100*b*. In the right end portion 100*b*, components disposed therein and the configuration of the casing are not identical to those in the left end portion 100*a*. Accordingly, though the shape, the number, and the layout of the suspending portions in the right end portion 100*b* differ from those in the left end portion 100*a*, the basic design concept of the suspending portions in the right end portion 100*b* are the same as that in the left end portion 100*a*.

At the right end portion 100*b*, suspending portions 30, 40 respectively corresponding to the suspending portions 10, 20 are formed so as to be suspended from the top wall 110*e*. Each of the two suspending portions 30, 40 that are spaced apart from each other in the front-right direction is a fastening portion (boss) for fastening the upper casing 110 and the chassis 120 to each other. The suspending portions 30, 40 respectively have shaft portions 31, 41 in which threaded holes 37, 47 are respectively formed.

The suspending portion 30 has a plurality of ribs formed integrally therewith. The plurality of ribs of the suspending portion 30 include a connecting rib 32 and a rib 34 respectively corresponding to the connecting rib 12 and the rib 14 of the suspending portion 10. The suspending portion 40 has a plurality of ribs formed integrally therewith. The plurality of ribs of the suspending portion 40 include a connecting rib 42 and ribs 43, 45 respectively corresponding to the connecting rib 22 and the ribs 23, 25 of the suspending portion 20. A retainer rib 46 corresponding to the retainer rib 26 of the suspending portion 20 is formed so as to extend from the rib 43. The ribs 32, 34, 42, 43, 45, 46 are connected to the top wall 110*e*. The connecting ribs 32, 42 are connected also to the right wall portion 110*b*.

Further, at the right end portion 100*b*, suspending portions 60, 63 respectively corresponding to the suspending portions 50, 53 are provided. The suspending portion 60 has a shaft portion 61 and a connecting rib 62 respectively corresponding to the shaft portion 51 and the connecting rib 52. The suspending portion 63 has a shaft portion 64 and a rib 65 respectively corresponding to the shaft portion 54 and the rib 55. The connecting rib 62 and the rib 65 are connected to the top wall 110*e*. The connecting rib 62 is connected also to the right wall portion 110*b*.

A retainer protrusion 48 that is continuous to the connecting rib 42 is formed so as to be suspended from the top wall 110*e*, as shown in FIG. 4B. The retainer protrusion 48 may have a rib-like shape or a shaft-like shape if permissible from the viewpoint of design. As indicated by the phantom line in FIG. 4B, another suspending portion 60, 63 may be additionally provided between the suspending portion 40 and the suspending portions 60, 63 in the front-rear direction, as in the left wall portion 110*a*.

The shape of the sound absorber 70 is basically similar to that provided in the left end portion 100*a*. The sound absorber 70 is sandwiched and held by the suspending portions 30, 40, 60, 63 and the retainer protrusion 48, owing to elastic deformation of the sound absorber 70. More specifically, the sound absorber 70 is held mainly by the connecting rib 32 and the rib 34 of the suspending portion 30, the shaft portion 41 and the retainer rib 46 of the suspending portion 40, the retainer protrusion 48, the shaft portion 61 of the suspending portion 60, and the shaft portion 64 of the suspending portion 63, such that the sound absorber 70 is fitted into a space defined by these ribs, shaft portions, and protrusion. Accordingly, the sound absorber 70 can be mounted from the backside without any fixing means such as screwing. The shaft portion 61 is located distant from the right wall portion 110*b*, thereby providing a spacing Sb between the sound absorber 70 and the right wall portion 110*b*.

Figure 5:
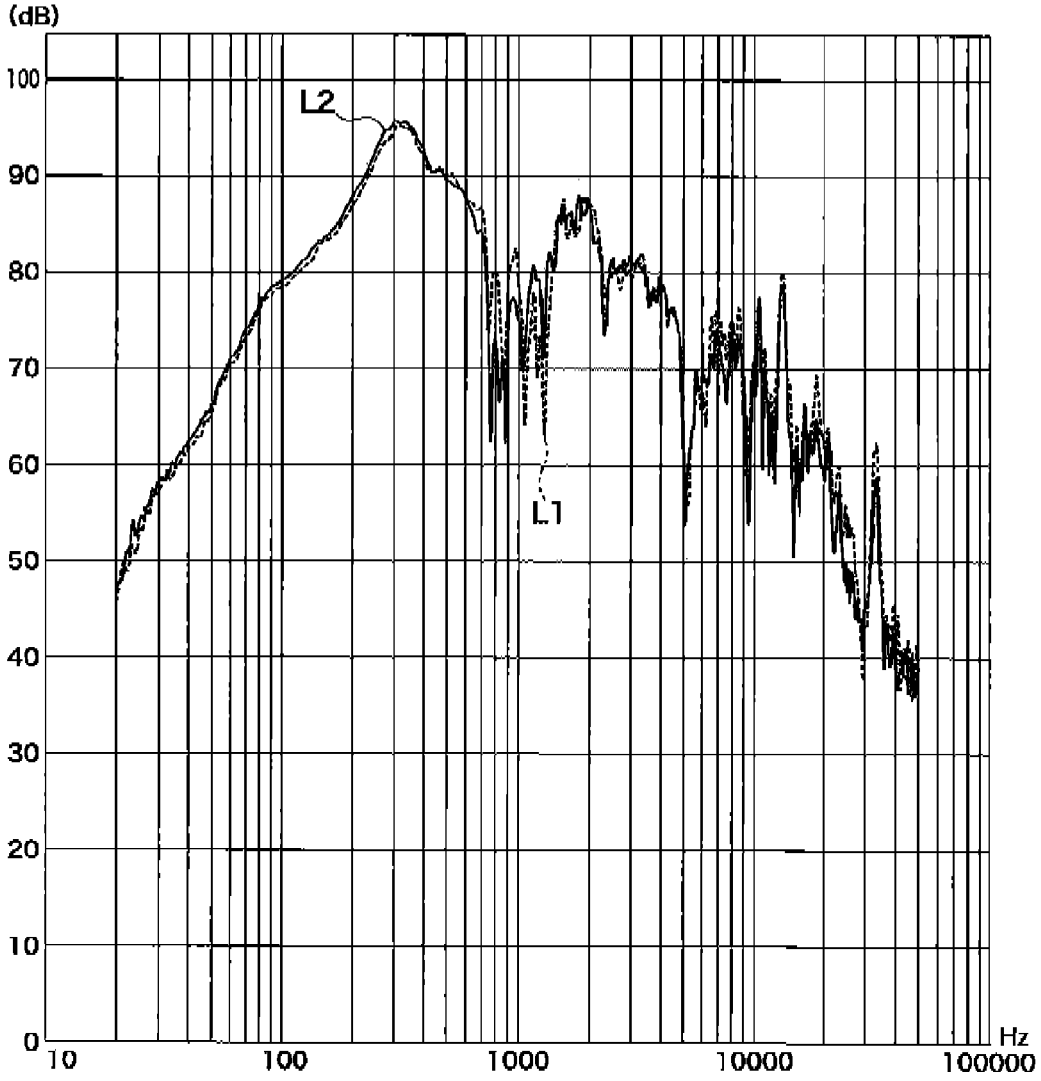
FIG. 5 is a graph showing frequency characteristics of acoustic signals generated from a speaker of the electronic keyboard musical instrument.

FIG. 5 is a graph showing frequency characteristics of acoustic signals generated from the speaker SPL of the electronic keyboard musical instrument 100. FIG. 5 shows characteristics L1 in a case in which the sound absorber 70 is not mounted and characteristics L2 in a case in which the sound absorber 70 is mounted. In the graph, the vertical axis indicates sound pressure level (dB) and the horizontal axis indicates frequency (Hz).

In measurement of the acoustic signals, the electronic keyboard musical instrument 100 is placed on a table having a height of 1 m. A microphone is disposed at a position that is above the center of the keyboard portion KB by about 40 cm and is forward of the center of the keyboard portion KB by about 15 cm. Performance sound emitted from the left speaker SPL was collected by the thus disposed microphone. The position of the microphone generally corresponds to a position of ears of a performer. Accordingly, the characteristic shown in FIG. 5 correspond to frequency characteristics of the performance sound heard by the performer.

When the characteristics L2 are compared with the characteristics L1, the sound pressure level increases as whole in a low frequency range (ranging from about 20 Hz to around 700 Hz) in the characteristics L2. In a middle and high frequency range (ranging from around 700 Hz to 1400 Hz), a variation in the sound pressure level is small and a fluctuation in acoustic characteristics is suppressed. While FIG. 5 shows actual measurement data of the left speaker SPL, it is estimated that the right speaker SPR would exhibit similar characteristics if actually measured because the housing CS has substantially left-right symmetry. The actual measurement revealed that the acoustic characteristics were more excellent when the sound absorbers 70 were positioned so as to be spaced apart from the left wall portion 110*a* and the right wall portion 110*b* by the spacings Sa, Sb than when the spacings Sa, Sb are not provided. It is noted, however, that provision of the spacings Sa, Sb is not essential.

Here, there is given a supplementary explanation on reasons why the acoustic characteristics are improved by the sound absorbers 70 disposed as described above.

First, the fluctuation of the acoustic characteristic in the middle and high frequency range is considered. Supposing that no sound absorbers 70 are provided, sound emitted from the speakers SP is reflected by the wall portion 110 constituted by a hard wall and is emitted ahead of the speakers SP, so that reflected sound overlaps directly emitted sound (direct sound). In contrast, in a case in which the sound absorbers 70 are provided, the direct sound overlaps indirect sound that is sound reflected by the sound absorbers 70. Accordingly, it is estimated that the characteristics observed from the measurement point is more likely to suffer from a fluctuation in the case in which no sound absorbers 70 are provided.

In other words, the indirect sound is a mixture of sound reflected by the surface of each sound absorber 70; sound reflected in the inside of each sound absorber 70; and sound that is reflected by the wall portion 110 after penetrating each sound absorber 70 while being attenuated, and is then transmitted through each sound absorber 70 while being further attenuated. If it is regarded that the direct sound is further mixed with the thus mixed indirect sound and the mixture of the direct sound and the indirect sound is represented as the acoustic characteristics, it is estimated that the fluctuation is smaller in the case in which the sound absorbers 70 are provided.

In a bare cone speaker, in general, sound is emitted also from the back surface of the cone portion, in addition to the direct sound. Accordingly, some sound component is canceled due to mutually opposite phases on the front side and the back side of the cone portion. Here, if the cone speaker is enclosed except for the cone portion, the so-called speaker box is formed. It is known that the speaker box ensures a higher volume, i.e., a higher sound pressure level, than the bare speaker. The sound pressure level is noticeably increased in the bass range in particular.

It is further known that the indirect sound (opposite phase sound) can be further attenuated by providing a cushioning material such as silk cotton or felt on the side surfaces and the back surface of the speaker box along walls of the speaker box and the sound pressure level of the sound emitted from the front surface of the speaker is accordingly increased. The sound pressure level is noticeably increased in the bass range in particular.

In view of the above, the opposite phase sound can be attenuated by providing the sound absorbers 70 respectively at the left end portion CSa and the right end portion CSb of the housing, without covering the entire inner wall of the housing, so that the acoustic characteristics in the bass range are improved in the case in which the sound absorbers 70 are provided.

The sound absorbers 70 are disposed respectively at the left end portion and the right end portion of the musical instrument, namely, one and the other of the opposite end portions of the musical instrument 100 in the left-right direction, whereby the Q factor in the acoustic characteristics is somewhat decreased. As a result, the sound pressure level is elevated or increased on the bass side. In the ordinary art, a steep rise on the bass side in the frequency characteristics of the acoustic signals is smoothened, namely, the sound pressure level on the bass side is elevated, by electrical filtering, in general. In the present embodiment, however, the sound absorbers 70 are disposed at the opposite end portions of the musical instrument in the left-right direction, whereby the sound pressure level on the bass side is elevated not by electrical processing but by mechanical processing. For the reasons discussed above, the acoustic characteristics in the low frequency range can be improved.

According to the present embodiment, the sound absorbers 70 are disposed respectively at the left end portion 100*a* and the right end portion 100*b* of the electronic keyboard musical instrument 100. Accordingly, it is possible to improve the acoustic characteristics and to suppress sound leakage from the left and right end portions 100*a*, 100*b*. In particular, the sound absorbers 70 are located at respective positions at which the sound absorbers 70 are spaced apart respectively from the left wall and the right wall (the wall portions 110*a*, 110*b*) of the housing CS with a spacing (Sa, Sb) interposed therebetween, thereby effectively suppressing a fluctuation in the acoustic characteristics.

In the present embodiment, the sound absorbers 70 are held by the suspending portions (e.g., 10, 20, 30, 40) that is suspended from the top wall 110*e* of the upper casing 110. Accordingly, the suspending portions have a function of reinforcing the housing CS and a function of holding the sound absorbers 70, thereby preventing the structure from becoming complicated. In addition, the sound absorbers 70 are held by the plurality of suspending portions so as to be fitted into a space defined by the plurality of suspending portions, so that the sound absorbers 70 can be held without a need of screwing while positioned in the horizontal direction. While each portion of the sound absorber 70 that is in contact with the corresponding suspending portion 20, 50, 53 is recessed as shown in FIG. 3, the portion may not be recessed in a state in which the portion is not in contact with the suspending portion 20, 50, 53. In this respect, the sound absorber 70 shown in FIG. 6A has recessed portions 70*a* (that will be explained) each having a shape corresponding to the shape of the shaft portion of each suspending portion 210 (that will be explained) in a state before the sound absorber 70 is held by the suspending portions 210.

Further, the suspending portions 10, 20, 30, 40 have a fastening function for attaching the chassis 120 and the upper casing 110 to each other, i.e., a function for assembling the housing, thereby preventing the structure from becoming complicated.

Each suspending portion 10, 20, 30, 40 has ribs formed integrally therewith, making it possible to increase rigidity thereof. Further, some of the ribs in each suspending portion 10, 20, 30, 40 (e.g., the connecting rib 12 and the rib 14, the connecting rib 32 and the rib 34, the connecting rib 42 and the retainer rib 46) are not parallel to each other, namely, extend in mutually intersecting directions in plan view. Accordingly, the rigidity is increased more effectively owing to the thus constructed ribs. Moreover, each suspending portion 10, 20, 30, 40 includes the rib (12, 22, 32, 42) which is formed integrally therewith and which is connected to the top wall 110*e* or one of the left wall portion 110*a* and the right wall portion 110*b*. Accordingly, it is possible to increase the effect of reinforcing the upper casing 110.

Some of the ribs (e.g., the ribs 12, 14, 22, 23, 26, 32, 34, 46) have a function of holding the sound absorber 70, so that the sound absorber 70 can be stably held over a large area thereof.

It is required for the suspending portion for holding the sound absorber 70 to be formed so as to be suspended from the top wall 110*e* and to have the function for reinforcing the upper casing 110. For instance, the sound absorber 70 may be held by only the suspending portions 50, 53 or the suspending portions 60, 63 that do not have the fastening function.

The structure of holding the sound absorber 70 by the suspending portions is not limited to that illustrated above. FIG. 6 shows a modified embodiment of the structure of holding the sound absorber 70.

Figure 6A:
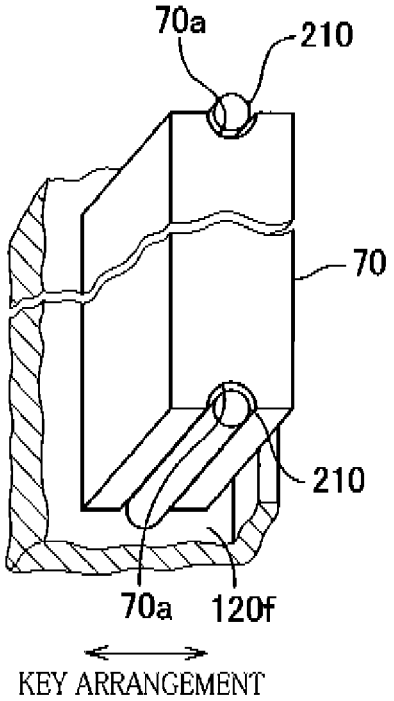
FIGS. 6A-6C are schematic views showing modified embodiments of a structure of holding a sound absorber.

For instance, when considering a case in which the sound absorber 70 is held by two suspending portions 210, as shown in FIG. 6A, the sound absorber 70 is formed with two recessed portions 70*a* each having a shape corresponding to the shape of the shaft portion of each suspending portion 210. In this case, the recessed portions 70*a* are in engagement with the shaft portions of the respective suspending portions 210 and the sound absorber 70 is in contact with the bottom surface 120*f* of the chassis 120, whereby the sound absorber 70 is immovably fixed, in other words, fixedly kept in place, also with respect to its thickness direction.

Figure 6B:
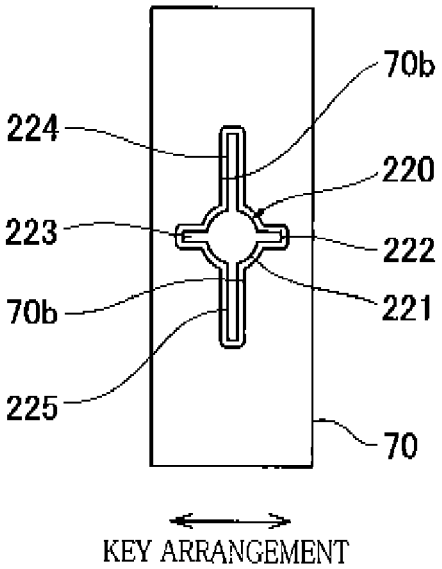

The sound absorber 70 may be held by a single suspending portion 220, as shown in FIG. 6B. In this instance, a hole 70*b* is formed in the sound absorber 70 so as to extend in the vertical direction. The suspending portion 220 is fitted into the hole 70*b* so as to extend therethrough. The suspending portion 220 has a shaft portion 221 from which four ribs 222, 223, 224, 225 extend in respective four directions. The shaft portion 221 and the ribs 222-225 are fitted into the hole 70*b*, whereby the sound absorber 70 is held by the suspending portion 220 while being prevented from rotating.

Figure 6C:
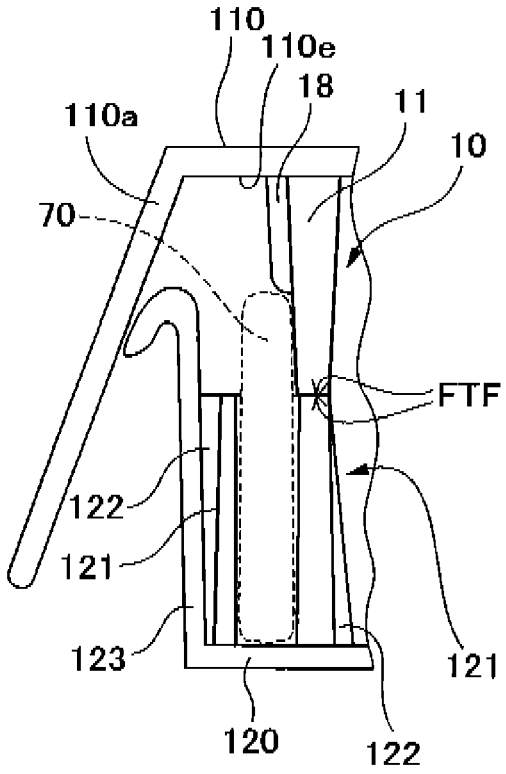

As shown in FIG. 6C that is a view in cross section along the left-right direction, the upper casing 110 and the chassis 120 may be attached to each other such that the suspending portion 10 that extends and protrudes downward (suspends) from the top wall 110*e* of the upper casing 110 and an upright portion 121 (as one example of a protruding portion) that extends and protrudes upward from the bottom surface 120*f* of the chassis 120 are held in contact with each other at a contact surface FTF. The sound absorber 70 may be held so as to be sandwiched by a plurality of upright portions 121, in addition to the plurality of suspending portions 10. The upper casing 110 may have a rib 18 that is formed integrally with the shaft portion 11 of the suspending portion 10 so as to contact the sound absorber 70 from above or the upper surface of the sound absorber 70 may be held in contact with the top wall 110*e*. The rib 18 is connected to the top wall 110*e*. While the rib 18 is not connected to the left wall portion 110*a*, the rib 18 may be connected to the left wall portion 110*a*. Owing to the rib 18 or the contact of the rib 18 and the top wall 110*e*, the sound absorber 70 is prevented from moving upward. It is possible to effectively suppress a fluctuation in the acoustic characteristics owing to the rib 18 and/or the sound absorber 70. The upright portion 121 may have a rib 122 formed integrally therewith. The rib 122 may be connected to the key bed 120*e* and/or a left wall portion 123 of the chassis 120. The suspending portion 10 and the upright portion 121 are coupled to each other by a screw mechanism. The sound absorber 70 may be held by the plurality of upright portions 121 without contacting the suspending portion 10.

It is possible to apply a structure similar to the illustrated structure of the protruding portion that protrudes from the upper casing 110 and the rib(s) formed integrally therewith to the structure of the protruding portion that protrudes from the chassis 120 and the rib(s) formed integrally therewith. Further, it is possible to apply the latter structure to the former structure.

The protruding portion may protrude from the left wall or the right wall (eg., the left wall portion 110*a*, the right wall portion 110*b*, the left wall portion 123) of the upper casing 110 or the chassis 120.

The speaker SP is disposed at at least one of opposite end portions of the housing CS in the left-right direction, and the sound absorber 70 is disposed at the at least one end portion. While provision of the tweeters Tw is not essential, the tweeters Tw are disposed so as to correspond to the respective speakers SP when provided. When only one of the left and right speakers SP is provided, one tweeter Tw is provided so as to corresponding to the one speaker SP.

The sound absorber 70 is illustrated as one example of a sound adjuster as an object to be held. The object to be held is not limited to the one that has sound absorbing function, as long as the object to be held has a sound adjusting function.

What is claimed is:

1. An, electronic keyboard musical instrument, comprising:

a housing having a lower casing which has a bottom wall, and in which an instrument component is disposed and an upper casing which has a top wall and which is attached to the lower casing, a left wall and a right wall being formed on at least one of the top wall of the upper casing and the bottom wall of the lower casing;

a keyboard portion held by the housing;

at least one speaker disposed at at least one end portion of the housing in a key arrangement direction of the housing on a rear side of the keyboard portion, such that a sound emission surface of the at least one speaker faces rearward, the at least one speaker being configured to generate a musical sound;

a sound adjuster disposed in the housing so as to be located outward of the at least one speaker in the key arrangement direction; and a plurality of protruding portions formed at the at least one end portion of the housing so as to protrude from the at least one of the top wall of the upper casing and the bottom wall of the lower casing, wherein the sound adjuster is held by at least one of the plurality of protruding portions.

2. The electronic keyboard musical instrument according to claim 1, wherein at least one of the plurality of protruding portions has a fastening function for attaching the upper casing and the lower casing to each other.

3. The electronic keyboard musical instrument according to claim 1, wherein at least one of the plurality of protruding portions has at least one rib formed integrally therewith, wherein the left wall and the right wall are formed on the at least one of the top wall of the upper casing and the bottom wall of the lower casing on which the plurality of protruding portions are formed, and wherein the at least one rib is configured to be connected to one of the left wall and the right wall that is nearer to the at least one of the plurality of protruding portions having the at least one rib.

4. The electronic keyboard musical instrument according to claim 1, wherein at least one of the plurality of protruding portions has at least one rib, wherein the left wall and the right wall are formed on the at least one of the top wall of the upper casing and the bottom wall of the lower casing on which the plurality of protruding portions are formed, and wherein the at least one rib is configured to be connected to the at least one of the top wall of the upper casing and the bottom wall of the lower casing and is configured not to be connected to the left wall and the right wall.

5. The electronic keyboard musical instrument according to claim 1, wherein at least one of the plurality of protruding portions has at least one rib, and wherein the at least one rib is configured to hold the sound adjuster.

6. The electronic keyboard musical instrument according to claim 3, wherein the at least one of the plurality of protruding portions has a plurality of ribs as the at least one rib, the plurality of ribs including two ribs that extend in one and the other of two mutually intersecting directions in plan view.

7. The electronic keyboard musical instrument according to claim 1, wherein the left wall and the right wall are formed on the at least one of the top wall of the upper casing and the bottom wall of the lower casing on which the plurality of protruding portions are formed, and wherein the sound adjuster is held so as to be spaced apart from the left wall and the right wall.

8. The electronic keyboard musical instrument according to claim 1, wherein the sound adjuster is held by the plurality of protruding portions.

9. The electronic keyboard musical instrument according to claim 8, wherein the sound adjuster is held by a plurality of ribs of the plurality of protruding portions.

10. The electronic keyboard musical instrument according to claim 1, wherein the sound adjuster is a sound absorber.

11. The electronic keyboard musical instrument according to claim 1, wherein the at least one of the plurality of protruding portions has a function of reinforcing at least one of the upper casing and the lower casing.

* * * * *